US005323910A

United States Patent [19]

van de Graaf, Jr.

[11] Patent Number: 5,323,910

[45] Date of Patent: Jun. 28, 1994

[54] PARTY PLATE

[76] Inventor: Pieter A. van de Graaf, Jr., 5214 Cobble Hill Rd., Portsmouth, Va. 23703

[21] Appl. No.: 88,576

[22] Filed: Jul. 8, 1993

Related U.S. Application Data

[63] Continuation of Ser. No. 925,860, Aug. 7, 1992.

[51] Int. Cl.[5] ..... B65D 1/36

[52] U.S. Cl. ..... 206/557; 206/564; 206/815

[58] Field of Search ..... 206/216, 217, 218, 815, 206/557, 562, 564, 541

[56] References Cited

U.S. PATENT DOCUMENTS

| | | | |
|---|---|---|---|
| 3,005,584 | 10/1961 | Coe | 206/562 X |
| 3,945,490 | 3/1976 | Thompson | 206/1.7 |
| 3,955,672 | 5/1976 | Brundage | 206/562 |
| 4,195,734 | 4/1980 | Boner et al. | 206/564 X |
| 4,219,144 | 8/1980 | Hagelberg | 206/564 X |
| 4,754,883 | 7/1988 | Grzywa | 206/564 X |
| 4,867,331 | 9/1989 | Task | 206/564 X |
| 4,966,297 | 10/1990 | Doty | 206/564 X |
| 5,062,531 | 11/1991 | Coy | 206/564 |
| 5,119,967 | 6/1992 | Ercolani | 206/564 X |
| 5,152,398 | 10/1992 | Forestal et al. | 206/562 X |

*Primary Examiner*—Jacob K. Ackun, Jr.
*Attorney, Agent, or Firm*—John K. Donaghy

[57] ABSTRACT

A party plate comprising a first portion having a top surface for holding food and a bottom surface for resting on the forearm of a user; a second portion attached to said first portion having a beverage container support; an aperture in the second portion for receiving a thumb of a user; and an edge on the second portion for providing a non-fatiguing grip for the fingers of a user.

1 Claim, 1 Drawing Sheet

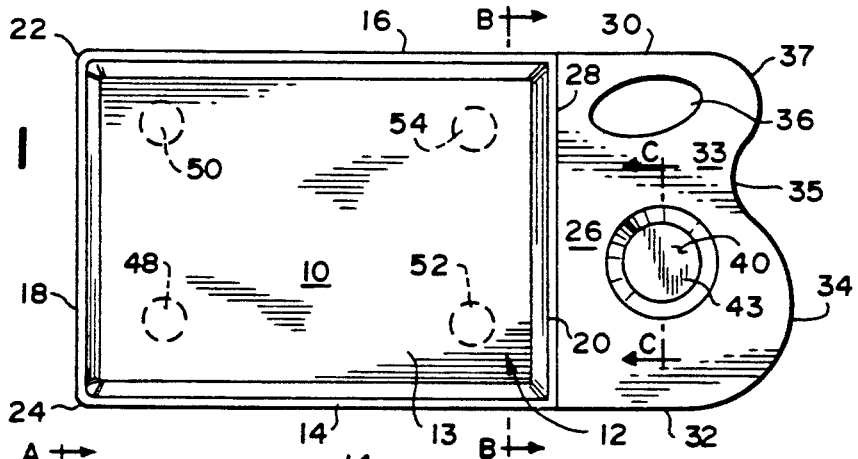
FIG. 1
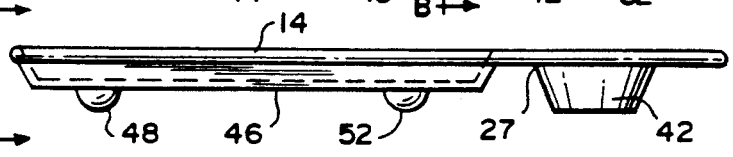
FIG. 2
FIG. 4
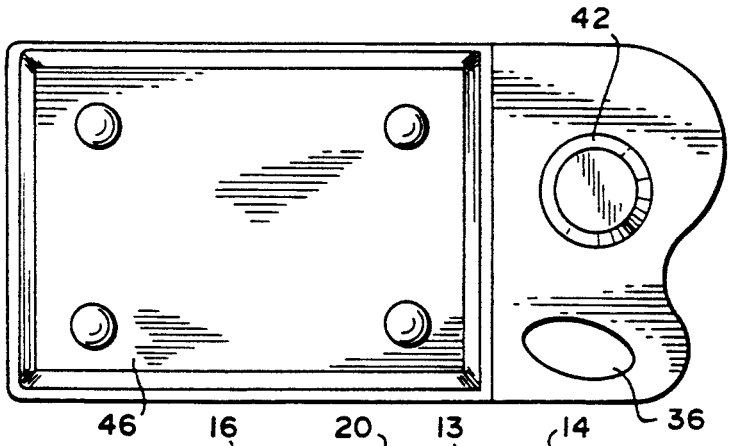
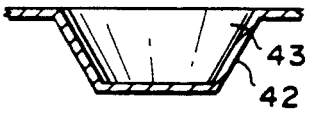
FIG. 6
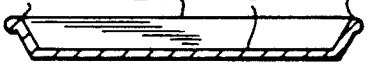
FIG. 5
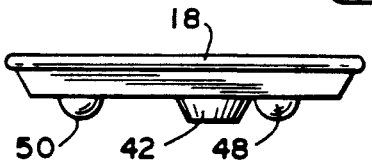
FIG. 3
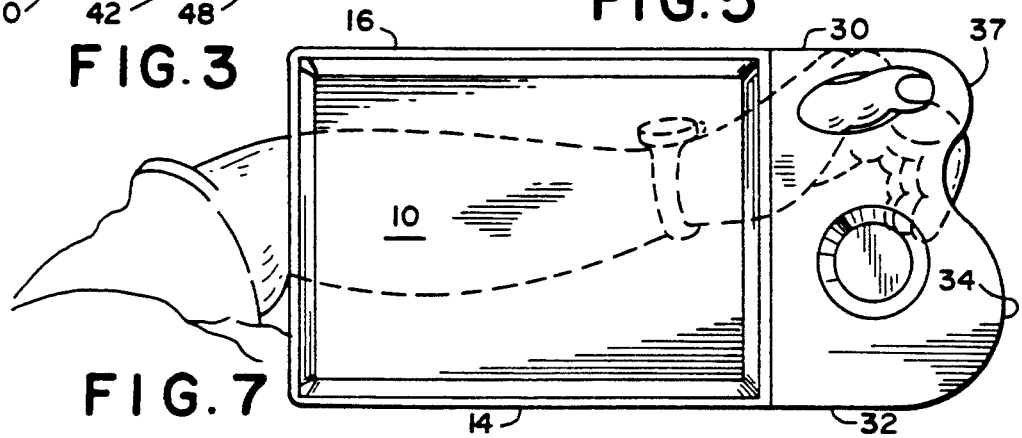
FIG. 7

PARTY PLATE

This is a continuation of Ser. No. 925,860 filed on Aug. 7, 1992.

BACKGROUND OF THE INVENTION

1. Field of the Invention

This invention relates to a food and drink serving tray, which rests on the forearm while in use, and which can be placed on a table if one wants to sit down. The plate also provides a pivot point around which weight can be shifted due to eating and drinking, while standing. A continuous tight grip of the plate is not required while standing and eating thus eliminating fatigue.

2. Background of the Prior Art

Several types of food serving plates or trays are known. One of the prior food serving trays is disclosed in U.S. Pat. No. 3,955,672. The patent discloses a food serving tray which rests on the forearm of the user and holds a cup in a cup retainer. The cup retainer, with cup, is held tight while resting the plate on the forearm. The plate, with the cup in the retainer, cannot be placed on a table as it would be off-balance. Additionally, the cup has to be held tightly continuously if one chooses to stand and eat. It is obvious that the latter is required, since the plate, with a cup in the cup retainer, cannot be placed on a table or temporarily set down. Another plate is described in U.S. Pat. No. 4,219,144. The patent discloses a serving tray with a circular basin for a drink as well as a thumb hole for carrying the tray. The thumb is placed through an opening and, according to FIG. 2, the bottom of the thumb rests on a corrugated surface. The remaining fingers support the bottom of the plate. The described usage is impractical, if not impossible. When the bottom of the plate is being supported by the fingers it is physically impossible to have the bottom of the thumb on the corrugated lip on top of the plate. Instead, the side of the thumb, next to the index finger, ends up supporting the weight from the top. Consequently, there is no way to adequately compensate for weight shifts by a fork pushing down on the plate. In this case, as the latter, the thumb and other indexes must hold the plate tightly for the entire duration of use. This causes fatigue and discomfort. Neither situation is a comfortable fit where one would be apt to not feel compelled to put the plate down as soon as one was finished eating.

SUMMARY OF THE INVENTION

The present invention is a serving plate for outdoor cookouts, inside hors d'oeuvres, or any other social gathering where snacks and drinks are served. The invention is an ergonomic design which overcomes some of the shortcomings of present plate designs.

The Party Plate consists of a serving tray with a cup/drink retainer which rests on the forearm while being carried or used while standing. A pivot hole is provided through which the thumb is placed. This pivot point allows the user to adjust to weight shifts by slightly turning the forearm away from or toward the body. The Party Plate does not have to be held tightly continuously while being used in the standing mode. Since the thumb provides a pivot point, the other indexes can be relaxed from time to time. The party plate can also be placed on a table without any problem while the cup is in the receptacle. The unique feature, which allows the plate to be carried like an artist's palate, provides an ergonomic design which surpasses any existing known plates.

The oval shape of the plate at the thumb hole is curved to comfortably fit the index finger. The remaining fingers curl up and support the tray from underneath. This provides allowance for a firm grip, when it is necessary.

The object of this invention is to provide an ergonomic tray design for use at social gatherings where people may need to eat and drink while standing, which remains equally functional when users choose to sit down.

Presently at social gatherings, a plate is used for snacks or meals. Meanwhile, a separate cup for a drink has to be juggled while standing and trying to eat and drink. The object of the present invention is to overcome this handicap. The Party Plate allows the user to stand in comfort, holding the tray, while eating and drinking without risk of spilling food and/or beverages.

The party plate will be made of a lightweight plastic material (polyethelene or polypropylene). A cheaper grade plastic and a corrugated paper material may be used for a different one time throw away version. This unique ergonomic design allows the user to stand and move about at a social gathering while eating and drinking without requiring a juggling act.

BRIEF DESCRIPTION OF THE DRAWINGS

FIG. 1 is a plan view of the serving tray showing a serving area, beverage cup holder, and thumb hole.

FIG. 2 is a side view of the serving tray.

FIG. 3 is an end view of the serving tray.

FIG. 4 is a bottom view of the serving tray.

FIG. 5 is a cross sectional view taken along the line BB of FIG. 1.

FIG. 6 is a sectional view taken along the line CC of FIG. 1, and

FIG. 7 is a perspective view of the plate resting on the arm of a user.

DETAILED DESCRIPTION OF THE PREFERRED EMBODIMENT OF THE INVENTION

Referring now in more detail to the drawings, FIG. 1 shows a food serving tray 10 having a first generally rectangular food serving portion 12 comprising a flat surface 13 below opposed sets of parallel side rails 14, 16, 18 and 20. The side rail 18 may be joined to the side rails 14 and 16 by corners 22 and 24. It will be seen that the serving surface 13 is lower than the rails 14–24 whereby food such as hors d'oeuvres or a sandwich will not slide off the tray. The depth of the surface 13 with respect to the rails 14–24 will be controlled by the width of the rail 14–24.

Adjacent and attached to the rectangular serving area 12 is a second portion 26 having an edge 28 attached to rail 20. This attachment may be integral or separable. The portion 26 comprises opposed side edges 30 and 32 joined to an end 33 comprising multi-curved edges 34 and 37 having a curved depression 35 therebetween. An oval hole 36 extends through portion 26 whereby the thumb of a user protrudes up from the bottom, with the thumb directed toward the edge 37. Having this grip secured, the user user would turn the tray so that the rectangular portion 12 rests on the forearm of the user. This resting position is desirable to prevent or eliminate fatigue which would otherwise occur if a user merely grasped the edge 33 and constantly held the tray by hand. The tray pivots around the thumb, so that the user can place his/her thumb in an upward direction and maintain the plate balanced on the forearm by a proper shifting of the forearm.

It will be seen that the portion 26 has a beverage cup or can holder 40 comprising dish portion 42, FIG. 2, extending below the bottom surface 27 of portion 26. The dish 42 is open at 43 to receive the bottom of a beverage container. The bottom 46 of portion 12 has a plurality of legs 48, 50 and 52 and 54 located at all corners of the portion 12. The Legs 48–52 serve as guides for the forearm of a user and serve to maintain the bottom 46 on the forearm of a user.

It will be seen that legs 48 and 50 are an opposed pair located adjacent rail 18 near the corner connectors 22 and 24. Legs 52 and 54 are located on the opposite side adjacent to rail 28. These four legs together with the dish portion 42 provides legs upon which the tray may be supported on a flat surface such as a table or counter top.

It will be appreciated that the curved edges 34 and 37 together with the depression 35 provide for an aesthetically pleasing appearance and for providing an edge for receiving the index finger of a user thus providing a comfortable and non-fatiguing grip surface for the user's index finger. The remaining fingers are curled underneath the tray and may be used in conjunction with the thumb pressing down from the top in instances when the plate needs to be held tightly, as when a food item is being cut or being pierced by a fork in preparation for eating.

While the invention has been described with regard to a preferred embodiment thereof, it will be appreciated by those skilled in the art to which the invention pertains that various changes may be made to the invention to enhance its function without departing from the scope and claims thereof.

What I claim is:

1. A party plate comprising:

a generally planar first portion having a top surface and a bottom surface, said top surface bounded by a perimeter of raised rails of equal height for containing food or said top surface, and said bottom surface for resting on a forearm of a user of said plate, said bottom surface further having legs adjacent corners defined by said first portion for supporting said first portion on a flat surface; and a second generally planar portion having a first end and a second end, said first end attached to said first portion outside said perimeter of raised rails, wherein said second portion extends parallel to said first portion, said second portion having a top, a bottom, and opposed side edges connecting said first and second ends, said second end comprising two outwardly curved portions separated by a depressed curved portion for functioning as a grip for said plate, said second portion having an aperture therethrough extending from said top to said bottom adjacent one of said side edges for insertion of a thumb of a user of said party plate, and a beverage container support adjacent the other of said side edges, said beverage container support comprising a dish portion having a side wall and a bottom wall and extending below the bottom of said second portion, wherein said dish portion and said legs cooperate to form a support for said plate in order to support said plate on a flat surface.

* * * * *